US005082146A

United States Patent [19]

Hardt

[11] Patent Number: 5,082,146

[45] Date of Patent: Jan. 21, 1992

[54] CONTAINER FOR MIXING AND EJECTION OF TWO COMPONENTS CONTAINED THEREWITHIN

[75] Inventor: Jean Hardt, Benken, Switzerland

[73] Assignee: Swiss Aluminium Ltd., Chippis, Switzerland

[21] Appl. No.: 455,398

[22] PCT Filed: Apr. 24, 1989

[86] PCT No.: PCT/CH89/00074

§ 371 Date: Dec. 22, 1989

§ 102(e) Date: Dec. 22, 1989

[87] PCT Pub. No.: WO89/10880

PCT Pub. Date: Nov. 16, 1989

[30] Foreign Application Priority Data

May 3, 1988 [CH] Switzerland ..... 1652/88

[51] Int. Cl.[5] ..... B65D 83/00

[52] U.S. Cl. ..... 222/135; 222/402.1

[58] Field of Search ..... 222/129, 135, 136, 145, 222/394, 402.1, 402.2, 541

[56] References Cited

U.S. PATENT DOCUMENTS

| | | | |
|---|---|---|---|
| 3,630,415 | 12/1971 | Morane et al. | 222/129 |
| 3,648,899 | 3/1972 | Lukesch et al. | 222/136 |
| 3,727,797 | 4/1973 | Cronan . | |
| 4,399,158 | 8/1983 | Bardsley et al. | 222/145 |
| 4,518,103 | 5/1985 | Lim et al. | 222/402.1 |
| 4,870,805 | 10/1989 | Morane | 222/394 |

FOREIGN PATENT DOCUMENTS

| | | | |
|---|---|---|---|
| 3806991 | 9/1989 | Fed. Rep. of Germany | 222/402.1 |
| 1586587 | 2/1970 | France . | |

*Primary Examiner*—Kevin P. Shaver
*Assistant Examiner*—Shari Wunsch
*Attorney, Agent, or Firm*—Bachman & LaPointe

[57] ABSTRACT

Container for one-time use for mixing and ejecting two components contained therewithin features a membrane that is situated inside the container and divides it into two chambers in which the components separately reside. The container is in the form of a pressurized package with outlet valve in which the membrane inside the container is sealed tightly to the same and is designed such that the introduction of a pressure difference in the chambers creates a force that opens the membrane.

6 Claims, 2 Drawing Sheets

CONTAINER FOR MIXING AND EJECTION OF TWO COMPONENTS CONTAINED THEREWITHIN

Figure 1:
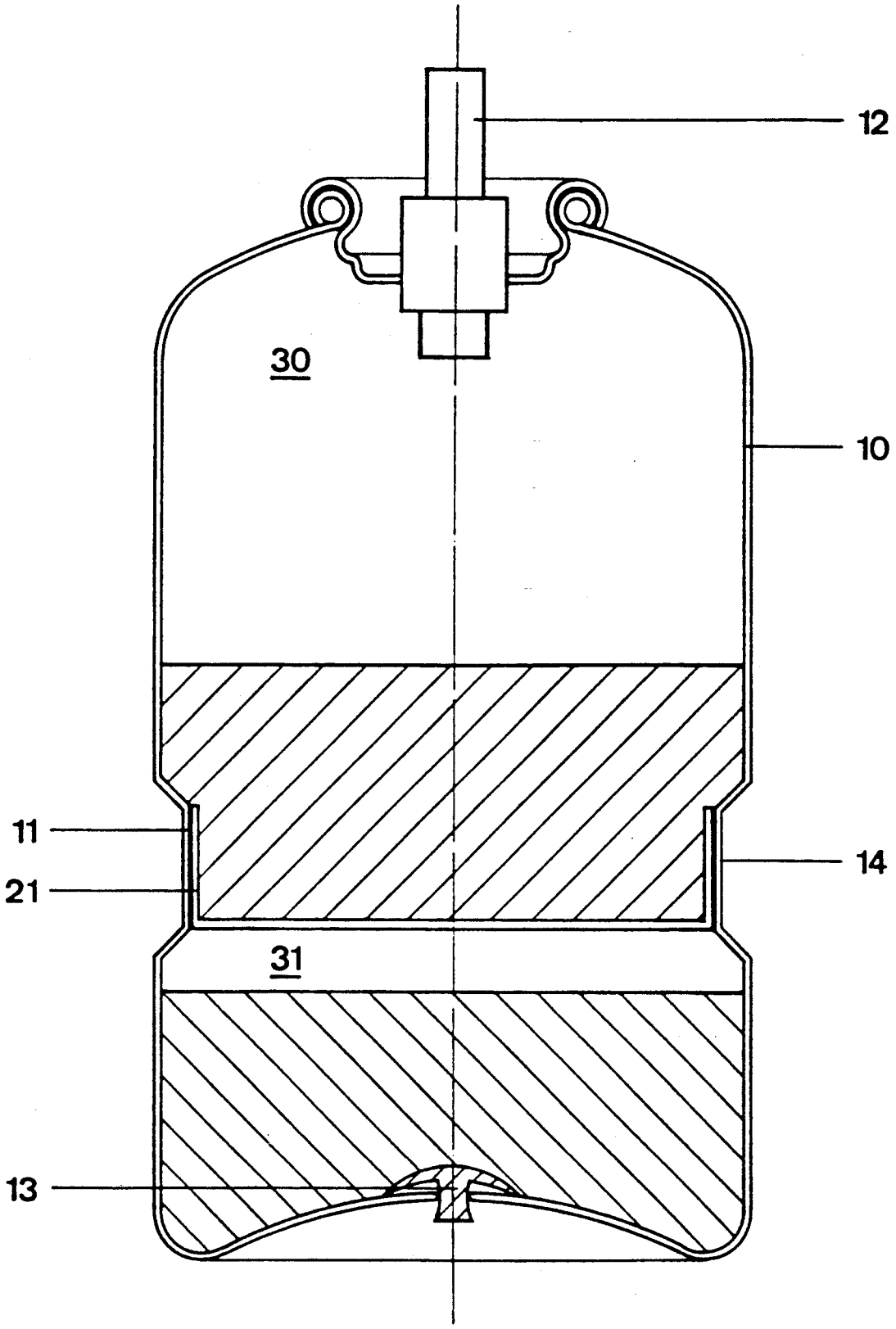

The invention relates to a container that is for mixing and ejection of two components contained therewithin said container being for one-time use, and featuring a membrane arranged on the inside dividing the container into two chambers in which the components separately reside.

Certain products such as, for example, hair dyes or adhesives comprise two components that have to be stored separately and mixed only just before use. In general the mixing of the two components, contained in two individual packages, is performed by transferring the component in one package to the component in the other package, the package holding the second component of course having sufficient volume to accommodate both components and possibly additional free space to make the mixing process easier.

A container of the foregoing kind is known which is not under positive pressure and in which the individual components are separated from each other by an aluminum foil. The mixing of the components takes place by penetration of the foil that acts as a membrane, this by means of a shaped part that is coupled to the flexible bottom and can be actuated by pressure of the finger, thus causing the component in one chamber to enter the other chamber resulting in a mixing of the two components. The ejection of the mixture is performed likewise by pressure of the finger on the flexible bottom.

Such containers have the disadvantage that, in order to fit the membrane to the container it is necessary to have a projecting flange on the outside of the container; the flange produces a bad visual impression and, furthermore, uneconomically increases the volume of the packaging which normally encloses the container for mixing.

The object of the present invention is to eliminate this disadvantage and, usefully, to replace the moveable mechanical means for penetrating the present membrane.

This object is achieved by way of a container according to the invention. The container for one-time use for mixing and ejecting two components contained therewithin features a membrane that is situated inside the container and divides the container into two chambers in which the components separately reside, characterized in that, the container is a pressurized package with outlet valve, and the membrane in the interior of the container is sealed tightly to the inside of the container and designed such that by the introduction of pressure difference in the chambers a force is created that opens the membrane.

Advantageous further versions of the container according to the invention provide that the membrane is pot-shaped and is bonded adhesively with a ring-shaped seal to the inner wall of the container. Also in a further version, the pressure difference opens the membrane by peeling and/or inverting the part of the membrane in contact with the inner wall of the container, and the components of one chamber can gain access to the components of the other chamber. Also in a further version, the difference in pressure at a weakened zone opens the membrane at a predetermined place of rupture, and the components of one chamber can gain access to the components of the other chamber. In a further version, the difference in pressure pushes the bottom of the membrane against a stop, whereupon the membrane opens and the component of one chamber can gain access to the components of the other chamber. The membrane is made, in a conventional manner, of metal, of plastic, plastic-plastic composite or metal-plastic composite. In a further embodiment, there is a narrowing of the container in the region where the membrane is attached.

Figure 2:
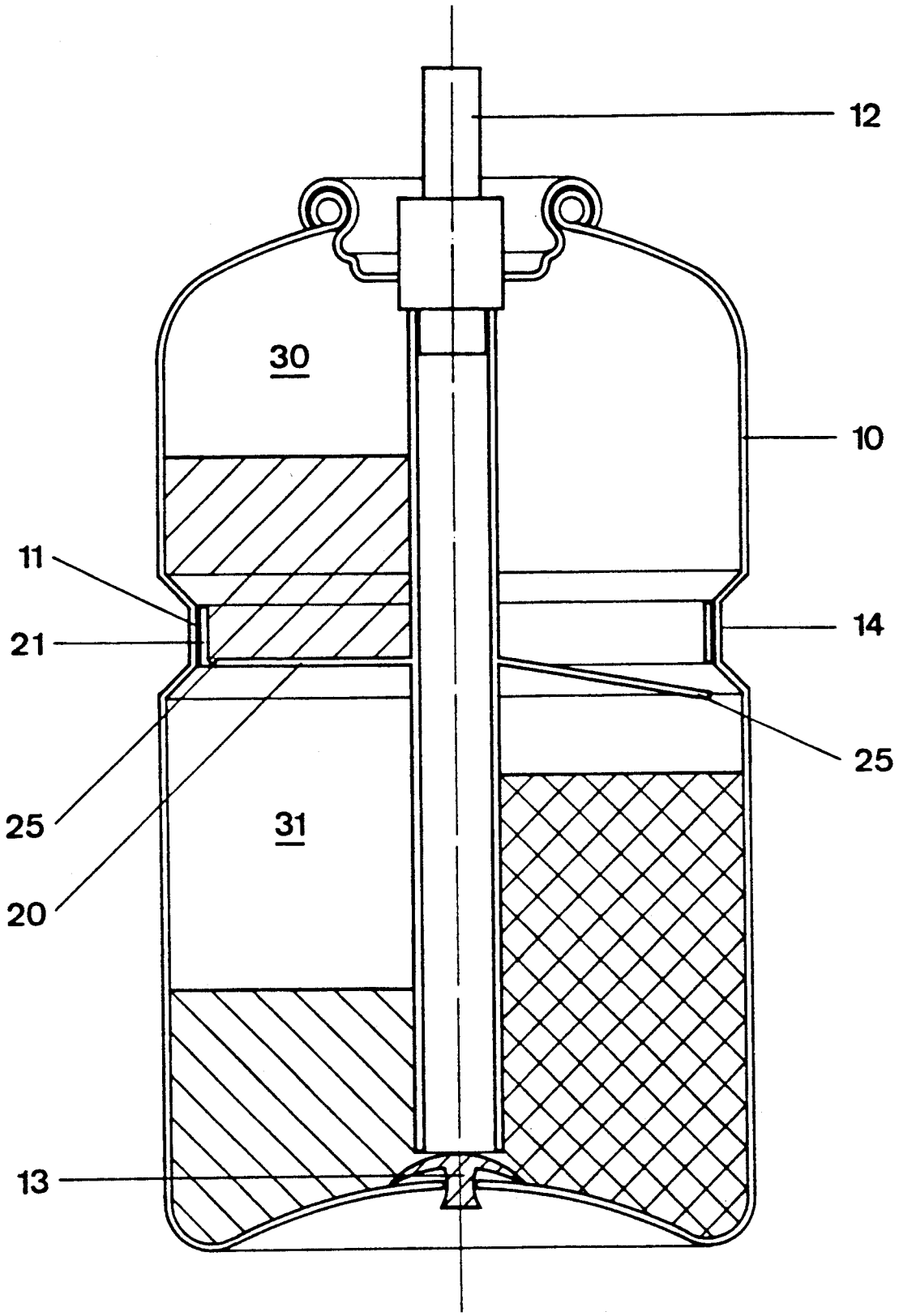

The container according to the invention is explained in greater detail by way of examples with the aid of the drawings in which FIG. 1 shows schematically a container with pot-shaped membrane and, FIG. 2 shows schematically a container with weakened zone as predetermined place of fracture.

As shown in FIG. 1 the container 10 according to the invention contains a pot-shaped membrane 20 that features an adhesive seam 21 on the side facing the inner wall 11 of the container 10, by means of which the membrane 20 is attached to the inner wall 11 of the container 10, as a result of which two chambers 30, 31 are formed; the said container 10 also features a valve 12 and possibly a plug 13 for filling chamber 31 with a component and gas under pressure. The other chamber 30 is filled with gas under pressure via the valve 12 after the other component has been introduced. During the storage of the container 10 there is always a pressure in chamber 30 that is greater than that in the other chamber 31. The penetration of the membrane 20 that enables mixing of the component takes place by way of a force, acting on the membrane 20, that is created by a pressure difference acting counter to the original pressure difference. By briefly actuating the valve 12, the over pressure in chamber 30 is reduced to such a degree that membrane 20, under the influence of the now reversed force of pressure, peels away at the seam 21 or is ruptured at a weakened zone 25 provided as predetermined place of fracture.

FIG. 2 shows on the left hand side a container 10 with a weakened zone 25 serving as predetermined place of fracture in the non-ruptured state, and the right hand side showing membrane 20 in the ruptured state.

To open the membrane 20 at the predetermined place the container must, before actuating the valve 12, be inverted i.e. stood on its head. This means the chamber 30 must be positioned below chamber 31. On actuating the valve 12 the pressure in chamber 31 is reduced to such a degree that the membrane can no longer withstand the pressure in chamber 30 and so tears at the predetermined place. Note that in FIG. 2 valve 12 extends to the bottom of the container.

After the mixing, which is aided further by shaking the container 10 with opened membrane 20, the product can be expressed via valve 12 under the action of the pressure medium.

I claim:

1. Container for one-time use for mixing and ejecting two components contained therewithin, which comprises: a pressurized container having an inner wall, a pot-shaped membrane situated inside the container bonded adhesively with a ring-shaped seal to the inner wall of the container dividing the container into two chambers, two components separately residing in said two chambers, an outlet valve communicating with the interior of the container, wherein the membrane in the interior of the container is sealed tightly to the inside of the container and designed such that by the introduction of pressure difference in the two chambers a force is created that opens the membrane with the pressure difference opening the membrane by peeling the part of the membrane in contact with the inner wall of the container, whereby the components of one chamber can gain access to the components of the other chamber.

2. Container according to claim 1 wherein the membrane is made of metal.

3. Container according to claim 1 wherein the membrane is of a material selected from the group consisting of plastic, plastic-plastic composite and metal-plastic composite.

4. Container according to claim 1 wherein there is a narrowing of the container in the region where the membrane is attached.

5. Container according to claim 1 wherein the container interior has an upper portion and lower portion and wherein the outlet valve extends to the upper portion.

6. Container according to claim 1 wherein the container interior has an upper portion and lower portion and wherein the outlet valve extends to the lower portion.

* * * * *